US007270616B1

(12) United States Patent
Snyder

(10) Patent No.: US 7,270,616 B1
(45) Date of Patent: Sep. 18, 2007

(54) BATTER MONITORING SYSTEM

(76) Inventor: Arthur C. Snyder, 242 Lake Huron Dr., Mulbery, FL (US) 33860

( * ) Notice: Subject to any disclaimer, the term of this patent is extended or adjusted under 35 U.S.C. 154(b) by 762 days.

(21) Appl. No.: 10/342,471

(22) Filed: Jan. 14, 2003

(51) Int. Cl.
*A63B 69/00* (2006.01)

(52) U.S. Cl. ..... 473/453; 473/455

(58) Field of Classification Search ..... 473/421, 473/451, 453, 455, 468, 499–500, 415–416, 473/422; 463/2–3; 434/247; 273/317.6, 273/108.3

See application file for complete search history.

(56) References Cited

U.S. PATENT DOCUMENTS 1,868,088 A * 7/1932 Blair ..... 473/499
2,121,742 A * 6/1938 McLaughlin ..... 473/499
2,440,042 A * 4/1948 Friedman ..... 315/76
4,577,863 A * 3/1986 Ito et al. ..... 473/453
5,401,016 A * 3/1995 Heglund et al. ..... 473/476
5,615,880 A * 4/1997 Booth et al. ..... 473/471
5,833,549 A * 11/1998 Zur et al. ..... 473/199
6,117,031 A * 9/2000 Malinauskas et al. ..... 473/570
6,159,113 A * 12/2000 Barber ..... 473/454
6,688,996 B1 * 2/2004 Mitani ..... 473/500

* cited by examiner

*Primary Examiner*—John M Hotaling, II

(57) ABSTRACT

The batter monitoring system is a modified home plate for baseball including a sensor unit to detect whether or not the bat crosses the plate as a hitter swings at a pitched ball and also when a runner crosses the plate. After the pitch, a green light is illuminated to indicate that the batter swung the bat or a red light is illuminated if the batter did not swing the bat. Each player would wear a transmitter which the sensor would detect as it crossed the plate, illuminating the lights and sounding a buzzer to indicate when the device is detected crossing the plate. This allows the umpire to watch the ball coming into the baseman's glove and determine whether the ball arrived before or after he heard the buzzer. The sensor, lights, control unit, and buzzer would be built into the plate, and the plate would be recessed into the ground so that its appearance does not differ from that of a conventional home plate.

6 Claims, 3 Drawing Sheets

FIG. 3
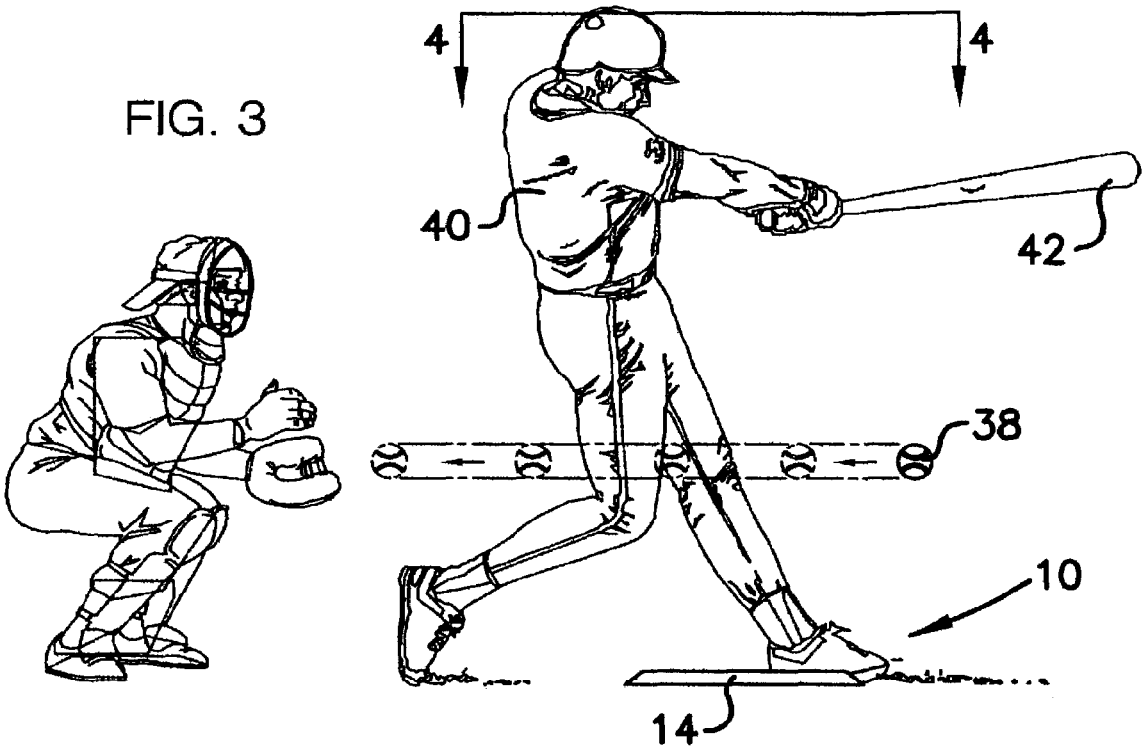
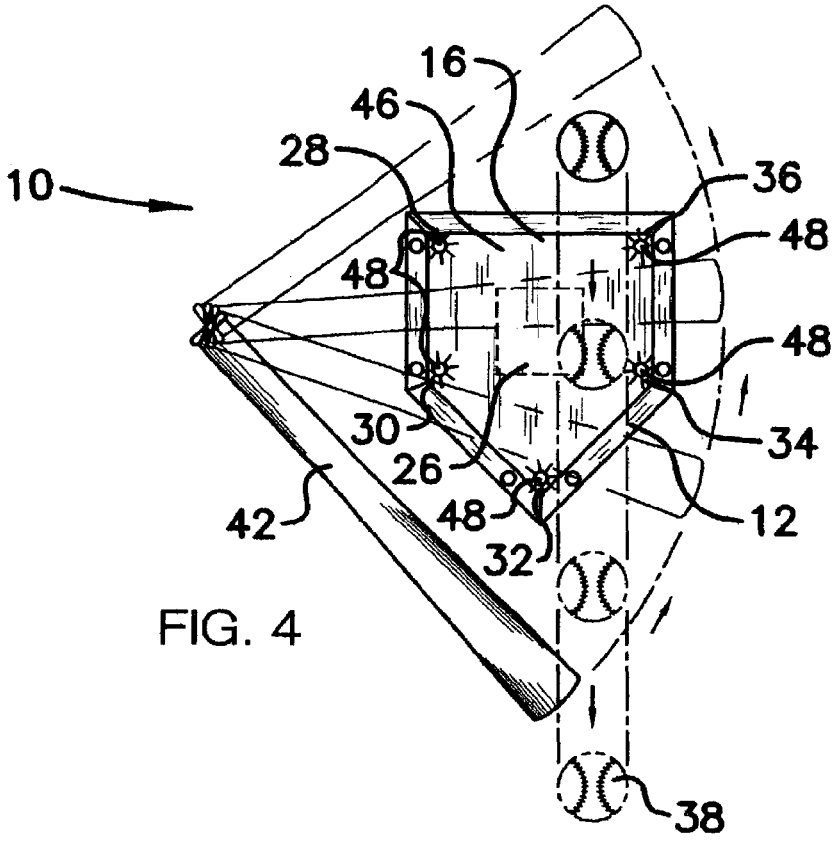
FIG. 4

BATTER MONITORING SYSTEM

BACKGROUND OF THE INVENTION

1. Field of the Invention

The present invention relates to sports apparatus for use in connection with the game of baseball. The batter monitoring system has particular utility in connection with aiding the umpire in determining if a player has swung his bat over the plate and the precise moment when a runner crosses the plate.

2. Description of the Prior Art

Calls made by umpires in baseball games have been questioned since the game originated. Some of the most questionable calls involve whether or not a batter has rotated past a certain point on a "check swing", which occurs when a batter tries to hold the bat back after he has started to swing. These calls are typically made by the first or third base umpires, depending on whether the batter is right or left handed, and are judgment calls on the part of the umpires. The umpire must determine if the batter will be charged with a strike depending on how far forward the bat was swung before the batter could stop the motion. Heated tempers can result from calls made in these types of situations; therefore, a device that could help the umpire determine if the player's bat has passed forward over the center of the plate would be extremely beneficial to the umpires.

Another type of call which is highly controversial is the umpire's call of a play at home plate. While the calls at all bases are critical, the plays at home plate are crucial because they directly affect the score in the game. Once again, these types of calls are judgment calls by the home plate umpire and are a source of contention with managers and players. Thus, a device which would aid the umpire in determining when a runner crosses the plate would help alleviate the disputes that occur over calls at home plate.

The use of batter monitors for aiding or replacing umpires is known in the prior art. For example, U.S. Pat. No. 5,401,016 to Kenneth W. Heglund, Michael P. O'Dierno, and Travis Scheckel discloses an automatic baseball ball and strike indicator that uses two transducers to detect the presence of an incoming pitch and a series of transducers located on the upper surface of a home plate shaped housing to determine whether the pitched ball is within the strike zone. However, while the size of the strike zone may be changed to accommodate batters of different heights in the Heglund, et al. '016 patent, this would take intervention by an operator of the device and would be time consuming since this procedure would need to occur for nearly every batter. Furthermore, if a ball were to cross through the strike zone and then hit a batter, entitling him to a walk, the Heglund, et al. '016 device would register it as a strike and would need to be cleared and reset so the ball/strike count for the next batter is correct. Finally, the transducers for detecting the incoming pitch and the LEDs for indicating the ball/strike count are located on the front edge of the plate in the Heglund, et al. '016 device where they would be susceptible to being covered with large amounts of loose dirt. Thus, this area of the plate would need to be frequently swept to allow the transducers to work properly and in order for the illumination of the LEDs to be seen.

U.S. Pat. No. 2,121,742 to Thomas F. McLaughlin discloses game apparatus that illuminates the outer edges of a home plate shaped base for improving the visibility of the area. However, the McLaughlin '742 patent does not aid the umpire in making a decision on whether the hitter has swung his bat over the plate. Furthermore, the McLaughlin '742 device does not alert the umpire when a runner has crossed the plate. Lastly, the McLaughlin '742 device utilizes incandescent bulbs for the illumination of the plate. These bulbs would need to be changed frequently, leading to cumbersome and time consuming maintenance since the home plate structure would need to be taken apart to accomplish this task.

Similarly, U.S. Pat. No. Des. 199, 128 to Paul S. Madsen discloses the ornamental design for a baseball home plate. However, the Madsen '128 patent does not provide a mechanism for aiding the umpire in determining if the hitter has swung his bat over the plate. Additionally, the Madsen '128 patent makes no provision for alerting the umpire when a runner crosses the plate.

U.S. Pat. No. 5,676,607 to Ernest A. Stumpf discloses a laser beam strike zone indicator wherein a plurality of adjustable laser beams are directed upwardly from the home plate to define a strike zone for a height of a predetermined batter. However each of the laser beams in the Stumpf '607 patent would need to be adjusted for each new batter, leading to an unacceptable time delay between batters. Moreover, no indication is given in the Stumpf '607 patent as to how the lasers are adjusted. Finally, no information is provided in the Stumpf '607 patent about whether the laser beams can differentiate between a baseball and another object, such as a bat, passing through the strike zone.

Likewise, U.S. Pat. No. 3,341,199 to Paul S. Madsen discloses a baseball and home plate that has stroboscopic properties in conjunction with pitched balls passing thereacross to provide an aid to the umpire in determining whether such pitched balls are balls or strikes. However, utilization of the Madsen '199 device requires the purchase of a large number of baseballs specifically designed for use with the Madsen '199 home plate. This could lead to excessive costs associated with the purchase of these baseballs. Moreover, play in games would need to be halted if a replacement ball was needed and the proper ball could not be located. Finally, the Madsen '199 patent makes no provision for aiding the umpire in determining if the hitter has swung his bat over the plate or for alerting the umpire when a runner crosses the plate.

U.S. Pat. No. 2,440,042 to Ernest Friedman discloses an indicating system for baseball games having bases which are so constructed and arranged as to indicate positively when a player has a foot on the base. However, the Friedman '042 patent requires the use a large number of magnetic devices on the bottoms of the shoes of each player. This could be cost prohibitive if large numbers of teams were to use these bases. Additionally, the Friedman '042 requires players on opposing teams to wear magnetic devices having opposite charges. If any player were accidentally given magnetic devices with the wrong charge, the system would fail to indicate the correct information. Finally, the Friedman '042 device fails to provide a means by which the umpire is aided in determining if a player has swung the bat across the plate in a check swing.

Lastly, U.S. Pat. No. 1,066,773 to Stephen H. Wills discloses a signal base for baseball fields that gives an alarm or signal when a runner reaches and touches a base. This is accomplished with a pair of plates that contact each other when a player steps on the plate, completing a circuit that sounds an alarm or gives some other indication. However, the Wills '773 patent does not take into consideration the fact that the baseman could inadvertently sound the alarm by stepping on the plate while attempting to catch the throw. Moreover, the ball could bounce on the plate and set off the alarm. Lastly, the Wills '773 patent makes no provision for aiding the umpire in calling checked swings by indicating when a hitter has swung his bat over the plate.

While the above-described devices fulfill their respective, particular objectives and requirements, the aforementioned patents do not describe a batter monitoring system that allows the umpire to determine if a player has swung his bat over the plate and the precise moment when a runner crosses the plate. The McLaughlin '742, Madsen '128, Madsen '199, Friedman '042, and Wills '773 patents make no provision for aiding the umpire in determining if the hitter has swung his bat over the plate, such as in a checked swing. Additionally, the McLaughlin '742 and Madsen '128 patent do not provide an indicator when a runner crosses the plate. False indications could be given by the Friedman '042, Wills '773, and the Heglund, et al. '016 devices. If any player wore magnetic devices with the wrong type of charge, the Friedman '042 system would fail to indicate the correct information. The Wills '773 patent fails to consider the fact that a fielder could inadvertently step on the base or that the ball could bounce on the base, both of which would set off the alarm indicating that the runner had touched the base. If a ball were to cross through the strike zone and then hit a batter, entitling him to a walk, the Heglund, et al. '016 device would register it as a strike and would need to be cleared and reset so the ball/strike count for the next batter was correct. Furthermore, no information is provided in the Stumpf '607 patent about whether the laser beams can differentiate between a baseball and another object, such as a bat, passing through the strike zone. Use of the Madsen '199 and Friedman '042 devices requires the purchase of large numbers of specialty items, such as striped baseballs for use with the Madsen '199 device and magnetic devices for use with the Friedman '042 device. Moreover, play in games using the Madsen '199 device would need to be halted if a replacement ball was needed and the proper ball could not be located. The McLaughlin '742 patent utilizes incandescent bulbs for the illumination of the plate. These bulbs would need to be changed frequently, leading to cumbersome and time consuming maintenance since the home plate structure would need to be taken apart to accomplish this task. Additionally, the transducers for detecting the incoming pitch and the LEDs for indicating the ball/strike count are located on the front edge of the plate in the Heglund, et al. '016 device where they would be susceptible to being covered with large amounts of loose dirt. Thus, this area of the plate would need to be frequently swept to allow the transducers to work properly and in order for the illumination of the LEDs to be seen. Furthermore, while the size of the strike zone may be changed to accommodate batters of different heights in the Heglund, et al. '016 and Stumpf '607 patents, this would take intervention by an operator of the device and would be time consuming since this procedure would need to occur for nearly every batter. Finally, no indication is given in the Stumpf '607 patent as to how the lasers are adjusted.

Therefore, a need exists for a new and improved batter monitoring system that can be used for aiding the home plate umpire in making calls. In this regard, the present invention substantially fulfills this need. In this respect, the batter monitoring system according to the present invention substantially departs from the conventional concepts and designs of the prior art, and in doing so provides an apparatus primarily developed for the purpose of aiding the umpire in determining if a player has swung his bat over the plate and the precise moment when a runner crosses the plate.

SUMMARY OF THE INVENTION

To attain this, the present invention essentially comprises a plate with the same shape as a conventional home plate and including an upwardly facing sensor unit, green and red indicating lights, and buzzer wherein the sensor unit is capable of detecting bat and ball movement and wirelessly interacts with a transmitter unit worn on the player's uniform and together form a batter monitoring system.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved batter monitoring system that has all of the advantages of the prior art batter monitors and none of the disadvantages.

It is another object of the present invention to provide a new and improved batter monitoring system that may be easily and efficiently manufactured and marketed.

An even further object of the present invention is to provide a new and improved batter monitoring system that has a low cost of manufacture with regard to both materials and labor, and which accordingly is then susceptible of low prices of sale to the consuming public, thereby making such a batter monitoring system economically available to the buying public.

Still another object of the present invention is to provide a new batter monitoring system that provides in the apparatuses and methods of the prior art some of the advantages thereof, while simultaneously overcoming some of the disadvantages normally associated therewith.

Even still another object of the present invention is to provide a batter monitoring system for determining whether a batter swings his bat across the plate after the pitcher delivers a pitch. This allows the umpire to determine if the batter has made a full swing or was able to "check" his swing and eliminates any controversy associated with this type of call.

Yet another object of the present invention is to provide a batter monitoring system that alerts the umpire by illuminating lights when a runner crosses the plate. This allows the umpire to concentrate on the ball arriving in the fielder's glove and determine if the ball arrives before or after the lights are illuminated, eliminating any controversy associated with this type of call.

Even yet another object of the present invention is to provide a batter monitoring system for alerting the umpire with a buzzer when a runner crosses the plate. This allows the umpire to focus on watching the ball as it arrives in the fielder's glove and determine whether it arrives before the buzzer sounds, eliminating any controversy associated with this type of call.

Still yet another object of the present invention is to provide a batter monitoring system which uses different colored lights to indicate when a batter swings at a pitch, when he does not swing at a pitch, and when a runner crosses the plate. This aids an inexperienced umpire in making calls at home plate and allows games to proceed with a replacement umpire should the scheduled umpire not show up for the game.

Lastly, it is an object of the present invention to provide a new and improved batter monitoring system which aids umpires in making judgment calls at home plate. This allows a baseball game to be played with fewer controversial calls, making the game more enjoyable for the players, coaches, fans, and umpires.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the batter monitoring system of the present invention after a batter swings and misses a pitch.

FIG. 4 is a top view of the batter monitoring system of the present invention after a batter swings and misses a pitch.

The same reference numerals refer to the same parts throughout the various figures.

DESCRIPTION OF THE PREFERRED EMBODIMENT

Figure 1:
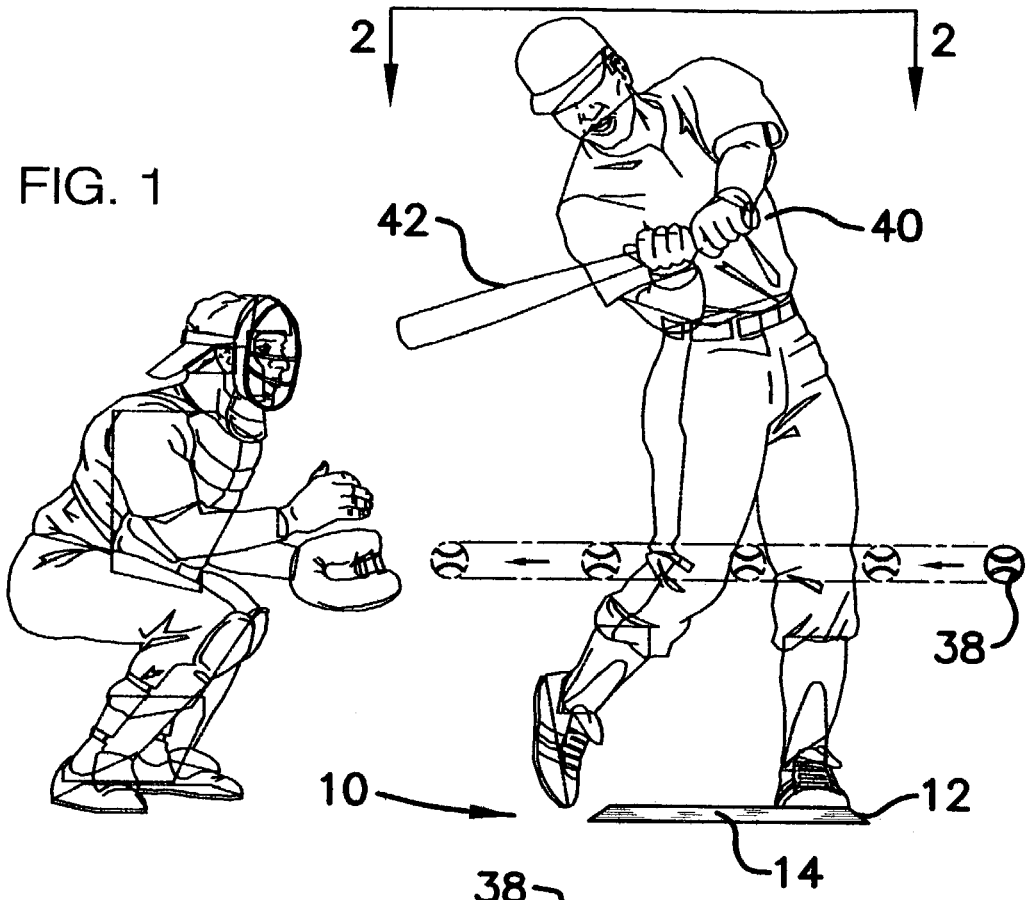
FIG. 1 is a side view of the preferred embodiment of the batter monitoring system constructed in accordance with the principles of the present invention and shown when a player chooses not to swing at the pitch.

Referring now to the drawings, and particularly to FIGS. 1-6, a preferred embodiment of the batter monitoring system of the present invention is shown and generally designated by the reference numeral 10.

Figure 2:
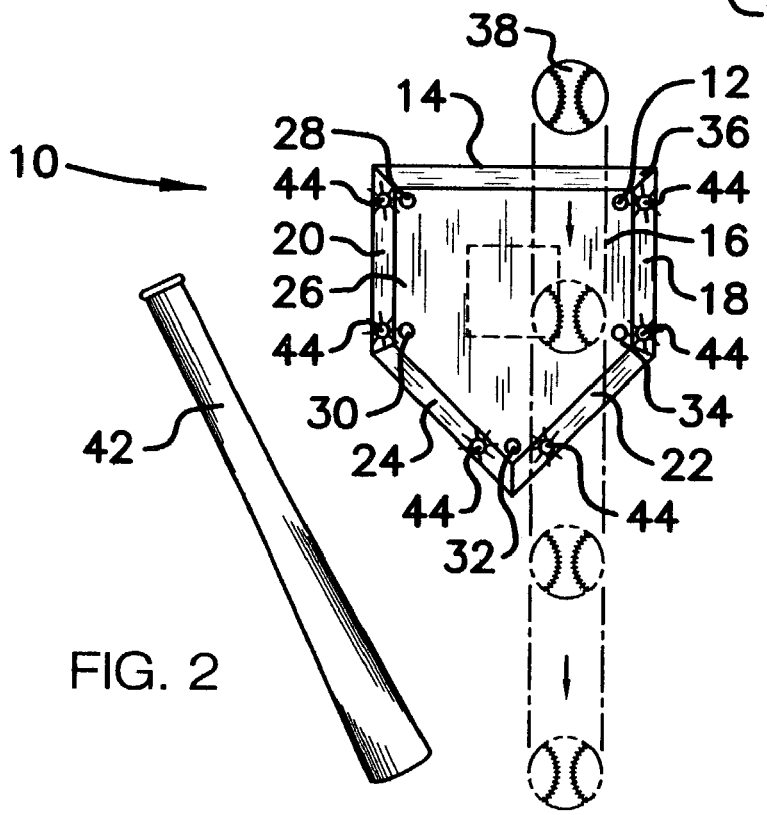
FIG. 2 is a top view of the batter monitoring system of the present invention after a player chooses not to swing at a pitch.
Figure 5:
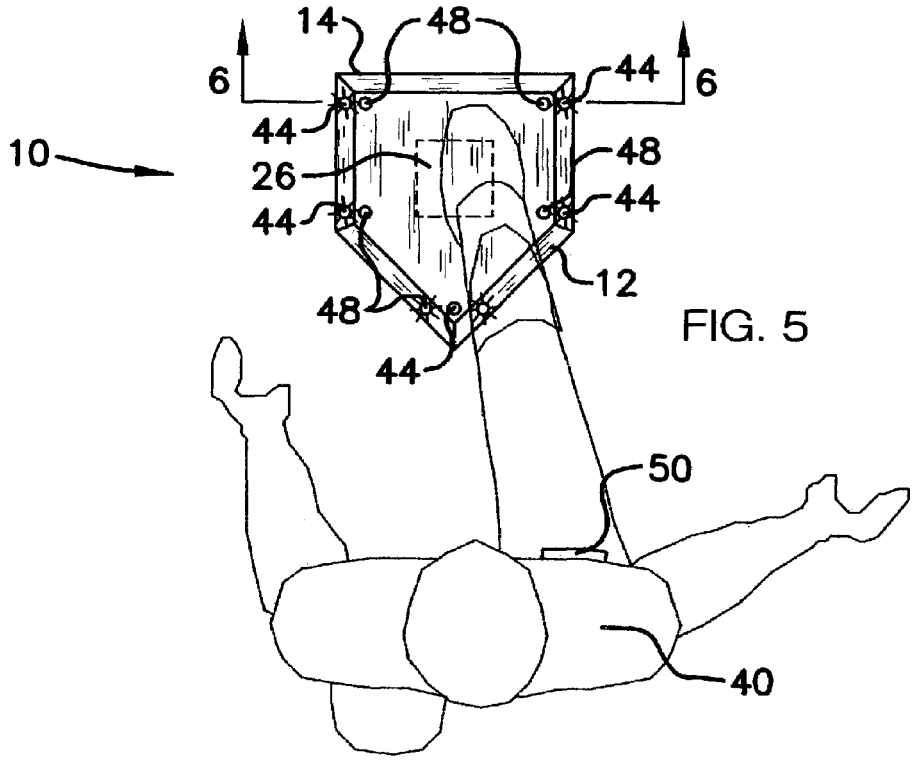
FIG. 5 is a top view of the batter monitoring system of the present invention as a runner crosses the plate.
Figure 6:
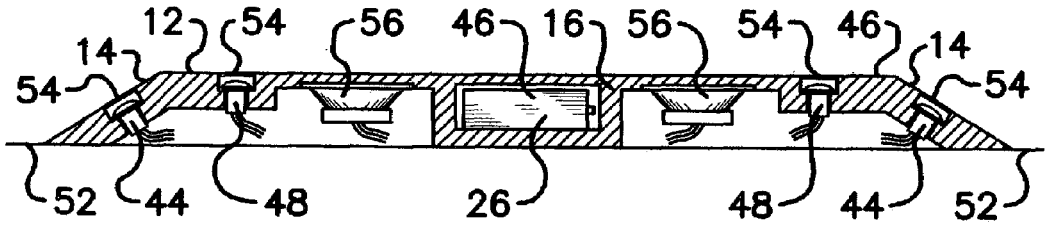
FIG. 6 is a rear sectional view of the batter monitoring system of the present invention.

In FIGS. 1-6, a new and improved batter monitoring system 10 of the present invention for aiding the umpire when making controversial calls is illustrated and will be described. More particularly, FIGS. 1 and 2 show the device when a batter chooses not to swing at a pitch, FIGS. 3 and 4 show the device when the batter swings and misses the pitch, and FIGS. 5 and 6 show the device when a runner crosses over it. The batter monitoring system 10 consists of a flat plate 12 having a conventional home plate shape with an outer edge 14 and a main body 16. The outer edge 14 of the home plate 10 can be further defined by a straight right edge 18, a straight left edge 20, an angled right edge 22, and an angled left edge 24. The main body 16 of the plate 12 has a main control unit 26 embedded in its center and may be defined by five defining points: the upper left corner 28, the lower left corner 30, the back center point 32, the lower right corner 34, and the upper right corner 36. The main control unit 26 consists of a sensor, a buzzer, and the logic necessary to control these devices. Any appropriate sensor could be used, such as one utilizing phased array radar. When the sensor detects a ball 38 crossing the 20 plate 12 as it is pitched to the batter 40 and does not detect the bat 42 crossing the plate 10, six red lights 44, two on the straight right edge 18, two on the straight left edge 20, one on the angled right edge 22, and one on the angled left edge 24, are illuminated.

FIGS. 3 and 4 show the batter monitoring system 10 when the batter 40 swings his bat 42 and misses a pitched ball 38. When the sensor detects the bat 42 moving forward over the top 46 of the plate 12 as the ball 38 passes over the plate 12, five green lights 48 on the main body 16 of the plate 12 are illuminated. One green light 48 is located at the upper left corner 28, one at the lower left corner, one at the back center point 32, one at the lower right corner 34, and one at the upper right corner 36.

FIGS. 5 and 6 show the batter monitoring system 10 when a runner 40 crosses over it. The player 40 would be equipped with a transmitter 50 which could be attached to his belt, pants, or shoe. When the sensor detects the runner's transmitter 50 crossing the plate 12, either the red lights 44 or the green lights 48 are illuminated and the buzzer is activated. FIG. 6 shows the rear sectional view of the device. The outer edge 14 of the plate 12 angles downward from the main body 16 to the level of the ground 52 into which it has been placed. The red lights 44 are flush with the outer edge 14 and are protected with a cover 54. The green lights 48 are flush with the top 46 of the main body 16 of the plate 12 and are also protected with a cover 54. The main control unit 26, containing the sensor and the buzzer are embedded within the center of the main body 16 of the plate 12. The buzzer is attached to a speaker 56 on each side of the main control unit 26. The speakers 56 are angled upward and reside just below the top 46 of the plate 12.

In use, it can now be understood that each player 40 would be equipped with a transmitter 50 which would be suitably attached to some part of his uniform. After the ball 38 was pitched, a green light 48 would come on to indicate that the batter 40 did not swing, or a red light 44 would come on to indicate that the batter 40 did swing at the pitch. During running plays, either the red or green lights, 44 or 48, would light up when the sensor detects a player 40 crossing the plate 12, and the buzzer would be activated. Activation of the lights and the buzzer would help the umpire make the correct call more often, helping reduce the number of arguments that occur during a game and increasing the enjoyment of the game for the players, coaches, and fans.

While a preferred embodiment of the batter monitoring system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable slightly flexible material such as rubber may be used for the home plate described. And although aiding the umpire in determining if a player has swung his bat over the plate and the precise moment when a runner crosses the plate have been described, it should be appreciated that the batter monitoring system herein described is also suitable for use in other sporting events when it is critical to know when a player or object crosses a certain demarcation, such as in track, soccer, football, hockey, and other sporting events.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A batter monitoring system comprising:

a flat plate shaped like a conventional home plate for baseball and having an interior surface and an exterior surface with a top layer having an upper rectangular section and a lower triangular section wherein said upper section has a right edge, a left edge parallel to said right edge, a top edge perpendicular to said right edge and joining said right edge to said left edge and forming an upper right corner and an upper left corner of said upper rectangular section, and a bottom edge which joins with said lower section forming a lower right corner and a lower left corner of said upper rectangular section and said lower section has a base that joins with said bottom edge of said upper section, a right angled outer edge that extends rearward and inward from said right edge of said upper section, and a left angled outer edge that extends rearward and inward from said left edge of said upper section and joins said right angled outer edge to define a rear center point of said plate and a bottom layer with a similar shape to said top layer wherein said top layer joins said bottom layer along said right edge, said left edge, said top edge, said right angled outer edge, and said left angled outer edge;

a sensor unit connected to said interior surface of said plate, wherein said sensor unit is located in the center of said upper rectangular section of said plate;

a transmitter wirelessly connected to said sensor unit;

control logic connected to said sensor unit and said interior surface of said plate;

a buzzer connected to said control logic and said interior surface of said plate;

a plurality of speakers connected to said buzzer;

a plurality of lights having a top and a bottom and connected to said plate wherein said bottoms of said lights are recessed within said plate, wherein each said light further comprises a protective cover connected to said plate wherein said cover is placed over said top of said light and is flush with said plate, and wherein some of said plurality of lights are red and are connected to said plate along said right edge, said left edge, said right angled outer edge, and said left angled outer edge; wherein said sensor unit is capable of detecting and differentiating between when a ball, a bat, or said transmitter crosses said plate, and said control logic illuminates said red lights when said sensor detects a ball crossing said plate but does not detect a bat crossing said plate after or at the same time as said ball.

2. The batter monitoring system 1 wherein some of said plurality of lights are green and are connected to said plate at said upper left corner, said lower left corner, said upper right corner, said lower right corner, and said rear center point.

3. The batter monitoring system of claim 2 wherein said control logic illuminates said green lights when said sensor detects a ball crossing said plate and a bat crossing said plate after or at the same time as said ball.

4. The batter monitoring system of claim 3 wherein said control logic illuminates said red lights and activates said buzzer when said sensor detects said transmitter crossing said plate.

5. The batter monitoring system of claim 3 wherein said control logic illuminates said green lights and activates said buzzer when said sensor detects said transmitter crossing said plate.

6. A batter monitoring system comprising:

a pentagonal flat plate having the dimensions of a conventional home plate used in baseball and formed with an interior surface and an exterior surface, a bottom layer, and a top layer having a main portion with a center and an outer edge with a right edge having a top and a bottom, a left edge with a top and a bottom and parallel to said right edge, a top edge having a first end, a center, and a second end and perpendicular to said right edge and joining said top of said right edge to said top of said left edge, an angled lower right edge having a top and a bottom and joined on said top to said bottom of said right edge, and an angled lower left edge having a top and a bottom and joined on said top to said bottom of said left edge and on said bottom to said bottom of said angled lower right edge wherein said bottom of said angled lower right edge joins with said bottom of said angled lower left edge at a point that lines up with said center of said top edge on a line parallel to said right edge and said left edge, wherein said bottom layer of said plate is slightly larger than said top layer of said plate and said right edge, said left edge, said top edge, said angled lower right edge, and said angled lower left edge slope downwards and outwards to join said top layer to said bottom layer;

a sensor unit connected to said interior surface of said plate, wherein said sensor unit is located in said center of said main portion of said plate;

control logic connected to said sensor unit and said interior surface of said plate;

a buzzer connected to said control logic and said interior surface of said plate;

a plurality of speakers connected to said buzzer and to said interior surface of said plate wherein said speakers are angled upward and are just below the top layer of said plate;

a plurality of red lights having a top and a bottom and connected to said plate along said right edge, said angled lower right edge, said left edge, and said lower left edge wherein said bottoms of said lights are recessed within said plate;

a plurality of green lights having a top and a bottom and connected to said main portion of said plate inside said right edge, said angled lower right edge, said left edge, and said lower left edge wherein each said green light is near one said red light and said bottoms of said lights are recessed within said plate; and a transmitter wirelessly connected to said sensor unit;

wherein said sensor unit is capable of detecting and differentiating between when a ball, a bat, or said transmitter crosses said plate; and control logic illuminates said red lights when said sensor detects a ball crossing said plate but does not detect a bat crossing said plate after or at the same time as said ball and illuminates said green lights when said sensor detects a ball crossing said plate and a bat crossing said plate after or at the same time as said ball.

* * * * *